US007252132B2

(12) United States Patent
Nien et al.

(10) Patent No.: US 7,252,132 B2
(45) Date of Patent: Aug. 7, 2007

(54) WINDOW COVERING

(75) Inventors: Ming Nien, Changhua Hsien (TW); David Pon, Tustin, CA (US)

(73) Assignee: Nien Made Enterprise Co., Ltd., Taichung (TW)

( * ) Notice: Subject to any disclaimer, the term of this patent is extended or adjusted under 35 U.S.C. 154(b) by 246 days.

(21) Appl. No.: 11/098,718

(22) Filed: Apr. 4, 2005

(65) Prior Publication Data

US 2006/0081341 A1 Apr. 20, 2006

Related U.S. Application Data

(63) Continuation-in-part of application No. 10/378,829, filed on Mar. 5, 2003, now Pat. No. 6,854,504, and a continuation-in-part of application No. 10/460,478, filed on Jun. 13, 2006, now Pat. No. 7,195,050.

(51) Int. Cl.
*A47H 5/00* (2006.01)

(52) U.S. Cl. ..... 160/84.01; 160/84.04

(58) Field of Classification Search ..... 160/84.01, 160/84.04, 84.06, 168.1 R, 176.1 R, 89, 160/348

See application file for complete search history.

(56) References Cited

U.S. PATENT DOCUMENTS 2,110,145 A * 3/1938 Loehr ..... 160/89
2,994,370 A * 8/1961 Pinto ..... 160/89
3,386,490 A * 6/1968 Kandel ..... 160/178.1 R
3,490,515 A 1/1970 Kandel
5,375,642 A * 12/1994 Gaber et al. ..... 160/168.1 R
5,664,613 A 9/1997 Jelic
5,775,399 A * 7/1998 Shields, Jr. ..... 160/176.1 R
5,787,951 A * 8/1998 Tonomura et al. ..... 160/84.01
5,829,506 A 11/1998 Zorbas
6,105,657 A 8/2000 Zorbas
6,675,859 B2 * 1/2004 Nien ..... 160/89
2004/0221969 A1 11/2004 Nien

* cited by examiner

*Primary Examiner*—David Purol
(74) *Attorney, Agent, or Firm*—Buchanan Ingersoll & Rooney PC

(57) ABSTRACT

A window covering has a headrail, a plurality of lift cords extending from the headrail and a plurality of shade elements positioned sequentially below the headrail. Each shade element has two longitudinal edges which are substantially parallel to one another. A flap made of mesh fabric, a non-woven fabric or a film through which light may pass is attached to one or both longitudinal edges of the shade elements. The shade elements are positioned so that when the shade elements are in a closed position the lower edge of one shade element abuts the upper edge of an adjacent shade element and when the shade elements are in an open position, the lower edge of the at least one shade element is spaced apart from the upper edge of an adjacent shade element. The flap may or may not fully cover the gap between adjacent shade elements. A first cord is attached to one longitudinal edge of each shade element and a second cord is attached to the other longitudinal edge of each shade element. These cords extend to or into the headrail and allow the longitudinal edges of adjacent shade elements to be moved away from one another to create a gap between adjacent shade elements through which light may pass.

12 Claims, 7 Drawing Sheets

WINDOW COVERING

CROSS REFERENCE TO RELATED APPLICATIONS

This application is a continuation-in-part of U.S. patent application Ser. No. 10/378,829, filed Mar. 5, 2003, now U.S. Pat. No. 6,854,504 and published on Jun. 3, 2004, as US 2004/0103994 A1 and U.S. patent application Ser. No. 10/460,478, filed Jun. 13, 2003, now U.S. Pat. No. 7,195,050 and published on Nov. 11, 2004, as US 2004/0221969 A1.

BACKGROUND OF THE INVENTION

1. Field of Invention

The invention relates to window coverings of the type having a plurality of spaced apart segments or shade elements, as in a venetian blind.

2. Description of the Related Art

Various vertical window blinds including venetian blinds, roller shades, roman shades, and the like are known. These window blinds commonly comprise a headrail, a bottom rail and a window covering material extending between them. Lift cords extend from the bottom rail into the headrail for raising and lowering the blind. The window covering material may be pleated or cellular material, woven woods or grasses or roman shade material that is raised and lowered or slats on ladders that can be raised and lowered as well as tilted for light control.

A venetian blind provides the widest range of light control. The slats can be raised to a fully open position, lowered to cover the entire window and tilted vertically to a fully closed position or lowered to a fully lowered or partially lowered position with the slats tilted at a selected orientation between vertical and horizontal. Roman, pleated and cellular shades have a softer appearance than venetian blinds. However, a conventional roman shade and other fabric shades can only be raised and lowered to cover all or a portion of the window. When a roman shade is in a fully lowered or partially lowered position, it cannot be controlled or adjusted to change the amount of light transmittance as occurs when one tilts the slats in a fully lowered or partially lowered venetian blind.

Although the slats in most venetian blinds are wood, aluminum or plastic, it is known to make fabric slats. One example of a fabric slat is disclosed in U.S. Pat. No. 5,829,506 to Zorbas. Like wood, aluminum and plastic slats fabric slats are hung on ladders or attached to ladder rungs and may have transverse stiffeners. Venetian blinds having fabric slats operate in the same manner as venetian blinds having wood, aluminum or plastic slats.

U.S. Pat. No. 6,105,657 to Zorbas discloses a fabric blind slat and a fabric venetian blind assembly. The fabric blind slat includes an elongated strip of fabric. The strip of fabric has at least one longitudinally extending pocket on a longitudinal edge into which a relatively rigid support member is insertable. This design of fabric blind slat has drawbacks. Tilting the fabric blind slat moves the fabric body of the fabric blind slat in a manner that causes the upper part of the fabric blind slat to compress the lower part of the fabric blind slat, resulting in a wrinkle. In other words, supporting or stretching means must be provided so that the fabric body of the fabric blind slat can be maintained smooth under any operation status.

Another type of venetian blind has a fabric sheet or fringe attached to one edge of each slat. This sheet or fringe extends to or below the adjacent slat. An example of this type of blind is disclosed in U.S. Pat. No. 3,388,490 to Kandel. In these blinds, the slats are supported on conventional ladders having parallel rails connected by a series of rungs of which the slats rest.

SUMMARY OF THE INVENTION

We provide a window covering having a headrail, two or more lift cords extending from the headrail and several operable shade elements or segments positioned sequentially below the headrail. Each shade element has at least one flap attached to one longitudinal edge of the shade element. The flap preferably is a mesh fabric, but may be a film or non-woven fabric through which light may pass. The shade elements are positioned so that when the shade elements are in a closed position the lower edge of at least one shade element abuts or is adjacent to the upper edge of an adjacent shade element. When the shade elements are in an open position, the lower edge of the at least one shade element is spaced apart from the adjacent shade element and a mesh fabric flap may cover the space between adjacent shade elements. Movement of the shade elements is controlled by a first cord or cords attached to one longitudinal edge of each shade element and extending into the headrail and a second cord or cords attached to the other longitudinal edge of each shade element. In one embodiment releasing the second cord raises the longitudinal edge of each shade segment creating a gap between shade segments. In another embodiment moving the first cord causes the other longitudinal edge of each shade element to fall creating a gap between shade segments. Another alternative is to connect both cords to a drum or shaft which when rotated will move the edges of each shade segment together to create the gap. The shade elements may be slats of the type used in venetian blinds or portions of a roman shade.

Other objects and advantages of the present method will become apparent from a description of the present preferred embodiments thereof as illustrated in the drawings.

DESCRIPTION OF THE PREFERRED EMBODIMENTS

Figure 1:
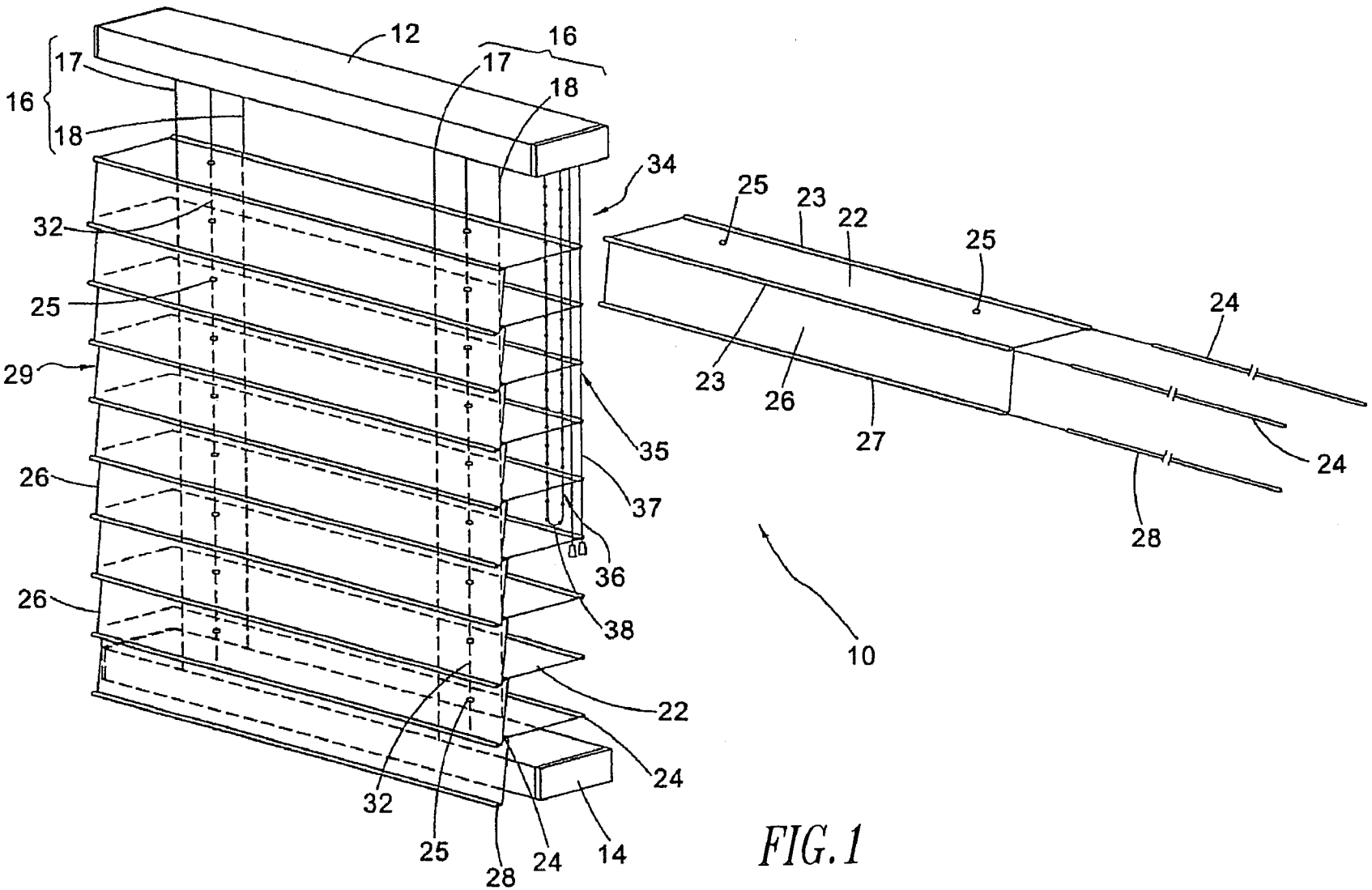
FIG. 1 is a perspective view, partially exploded, of a first preferred embodiment of the present invention.

Referring to FIGS. 1 through 5 a first present preferred window covering 10 is comprised of a headrail 12, a bottomrail 14, sets 16 of rails 17, 18, a plurality of shade elements in the form of flexible slats 22, a plurality of flexible light screening flaps 26, two lift cords 32, and a control unit 34. The headrail 12 is a hollow frame bar transversely (horizontally) affixed to the top side of a window (not shown). The bottomrail 14 is a hollow frame bar arranged parallel to and suspended from the headrail 12.

Each set 16 is comprised of a front rail 17 and a rear rail 18. The rails 17 and 18 each have a top end respectively inserted into the headrail 12 and a bottom end fixedly connected to the bottomrail 14. According to this embodiment, the rails 17 and 18 are symmetrically provided at two sides. Depending upon the transverse width of the window, the combination window covering can be equipped with more sets of rails. The rails could be offset from one another.

The slats 22 are narrow, elongated, rectangular members made of fabric of low penetrability to light, and arranged in parallel between the headrail 12 and the bottomrail 14 within the space defined between the front rails 17 and the rear rails 18. Each slat 22 has two sleeves or pockets 23 respectively extended along the respective two opposite long sides. Two plastic or metal ribs 24 are respectively inserted into the sleeves 23 and respectively connected to the front rails 17 and the rear rails 18. The slats 22 have two holes 25 for the passing of the lift cords 32. The ribs 24 support the flexible slat 22 to maintain its shape. The sleeves or pockets 23 have slots so that the respective loops of the rails 17 and 18 can encircle the ribs 24.

Figure 2:
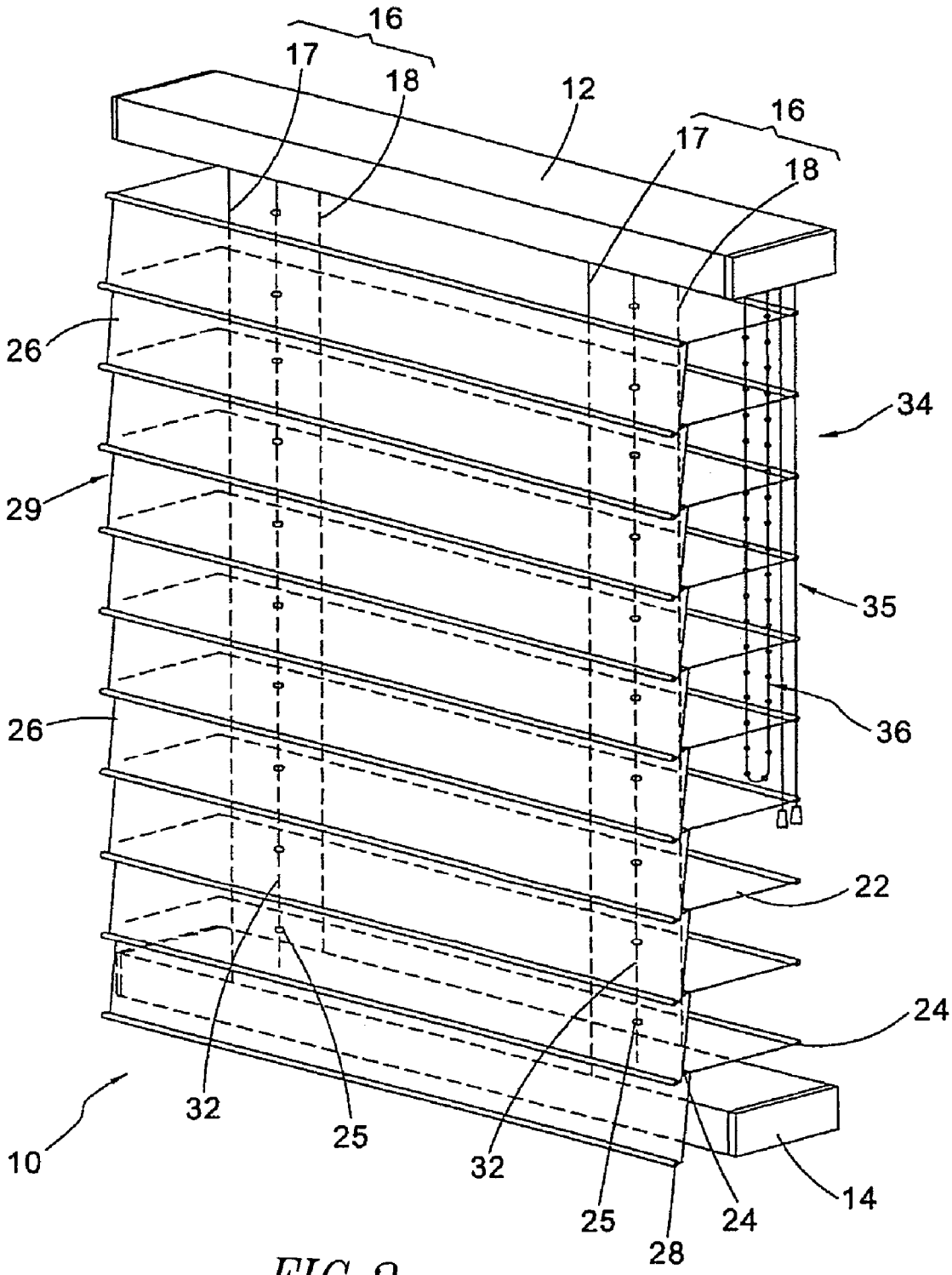
FIG. 2 is a perspective view of the embodiment shown in FIG. 1.
Figure 3:
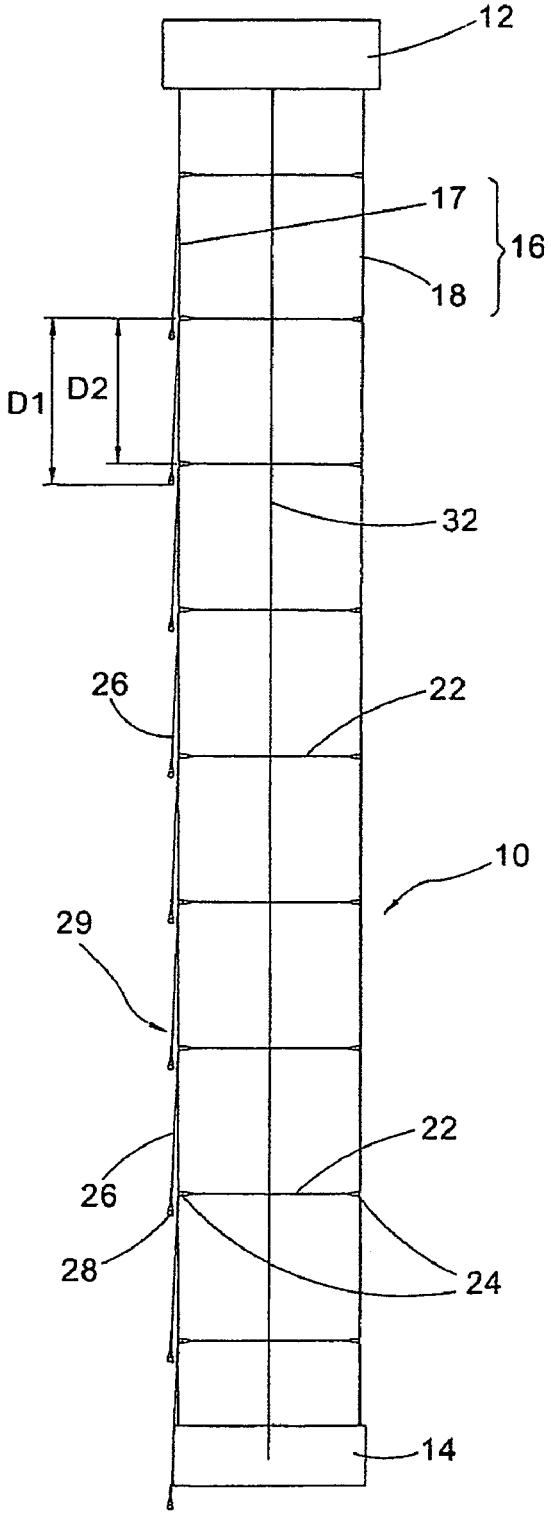
FIG. 3 is a side view of the blind shown in FIG. 1 with the blind in a fully lowered, open position.

The flexible light screening flaps 26 of the slat units are rectangular pieces of meshed fabric or film equal to the length and number of the flexible slats 22, and have a permeability to light relatively higher than the light permeability of the slats 22. The flap preferably is a mesh fabric, but may be a film or non-woven fabric through which light may pass. Each flap has one long side or longitudinal edge stitched to one long side or longitudinal edge of one flexible slat 22. The other long side, or longitudinal edge, of each flap is provided with a sleeve or pocket 27 and a rib 28 in the sleeve 27. That longitudinal edge is free to move. As illustrated in FIG. 3, the flexible light screening flaps 26 are respectively vertically suspended from the slats 22. The width $D_1$ of the flexible light screening flaps 26 preferably is slightly greater than the distance or pitch $D_2$ between two adjacent slats 22, when those slats are in a horizontal position. Therefore, when the flexible light screening flaps 26 are suspended from the slats 22, the bottom side edges of each flexible light screening flap 26 is lower than the elevation of the front longitudinal edge of the respective slat 22 below, i.e., the bottom side edge of each flexible light screening flap 26 covers the front edge of the next slat 22. In this way, the flexible light screening flaps 26 form a light screening face 29 on one side of the combination window covering 10, as shown in FIG. 2. Flexible light screening flaps may be respectively fastened to the other longitudinal edge of each of the flexible slats. Then there would be a light screening face on both sides of the combination window covering.

The control unit 34 comprises a lift cord mechanism operated by cords 35 and a tilt control mechanism operated by cord loop 36. The lift control mechanism is to be operated by the user to lift or lower the bottomrail 14, so as to further stack or extend the slats 22. The tilt mechanism is adapted to control relative movement of the front ladder rails 17 and the rear ladder rails 18 vertically in opposite directions, so as to tilt the slats 22. The control unit 34 is of the known art and can comprise two rod members (not shown) fastened rotatably with the inside of the headrail 12, a pair of reels (not shown) respectively mounted on one rod member, a barrel for each pair of rails mounted on the second rod member, a lift-control operation cord set 35 and a tilt-control operation chain 36 respectively coupled to the rod members for operation by the user to rotate the rod members respectively. The top ends of the lift cords 32 are respectively fastened to the two reels on the second rod member. The front rails 17 and rear rails 18 of the sets 16 are respectively coupled to opposite sides of the barrels on the first rod member. Because the control unit is of the known art, no further detailed description in this regard is necessary.

Figure 4:
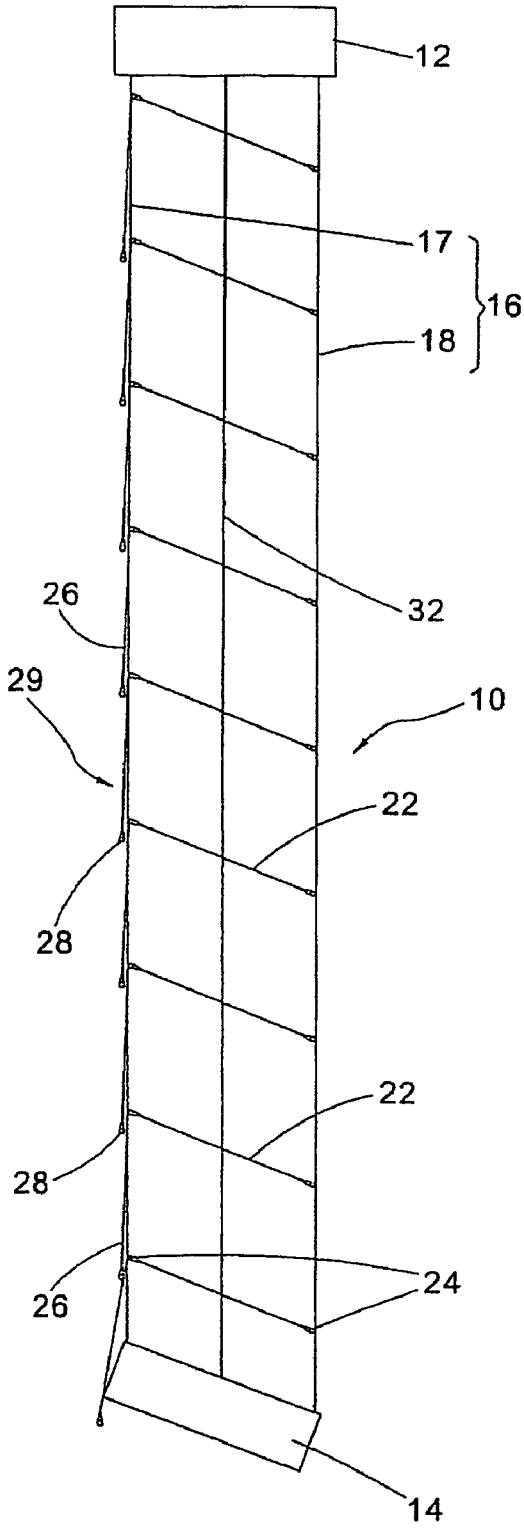
FIG. 4 is a side view similar to FIG. 3 with the blind in a fully lowered, partially closed position.

When this combination window covering 10 is assembled, the slats 22 may block the light or the sight between the outside of the room and the inside of the room. By means of operating the tilt control cords 36 of the control unit 34 to move the front rails 17 and the rear rails 18 in opposite directions, the slats 22 are tilted to regulate the light, as shown in FIGS. 3 and 4.

The flexible light screening flaps 26 are vertically suspended from the slats 22 at the front side. The ribs 28 of the flexible light screening flaps 26 support the front long side of each flexible flap 26 to stabilize and smoothen the suspension of those flaps forming the aforesaid light screening face 29. The light screening face 29 screens and softens the light, producing a soft and pleasant atmosphere in the room.

Figure 5:
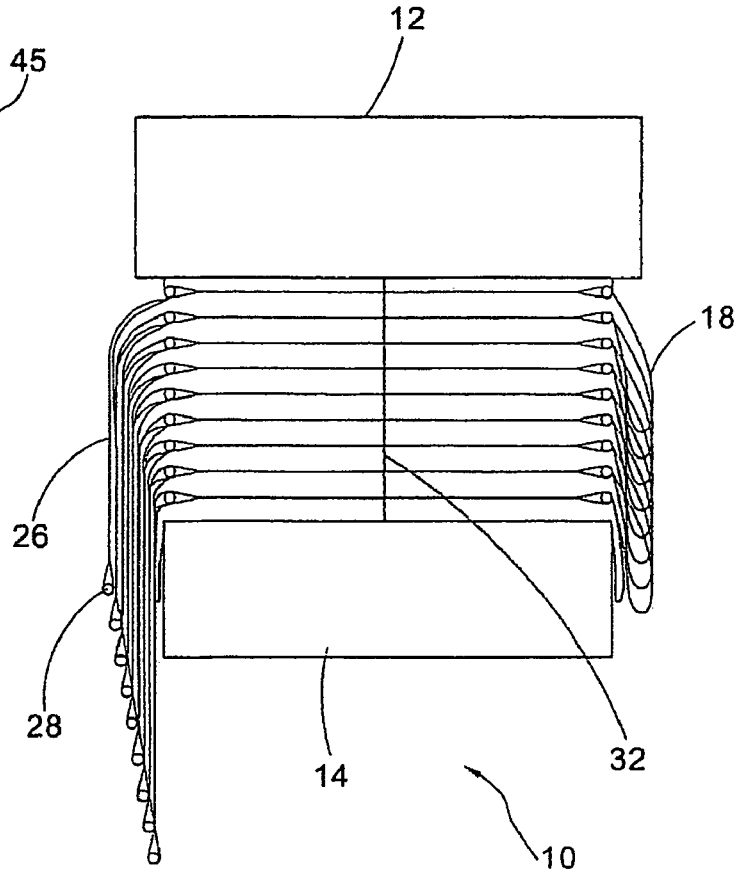
FIG. 5 is a side view of the embodiment shown in FIGS. 1 through 4 in a fully raised position.

When operating the lift control cords 35 of the control unit 34 to roll up the lift cords 32, the bottomrail 14 is lifted, and the slats 22 are stacked onto one another from the bottom side toward the top side to the fully raised position shown in FIG. 5. When the slats 22 are stacked together, the flexible light screening flaps 26 are overlapped on one another in order as shown in this figure.

In comparison with other conventional products having similar functions, the window covering material 10 shown in FIGS. 1 through 5 has a simple structure and is easy to manufacture. Further, it is practical to have the slats and the light screening flaps made of the same fabric material, i.e., each light screening flap and the corresponding slat can be formed of one single piece of fabric sewn to form a flexible slat and an integrated light screening flap light. The portion of the single piece of fabric forming the slat may be coated with a layer of film or color paint.

As indicated above, the slats, as well as the light screening flaps are preferably made of fabric instead of conventional plastic or wooden material. Therefore, the combination window covering softens the light, producing a pleasant atmosphere in the house.

Figure 7:
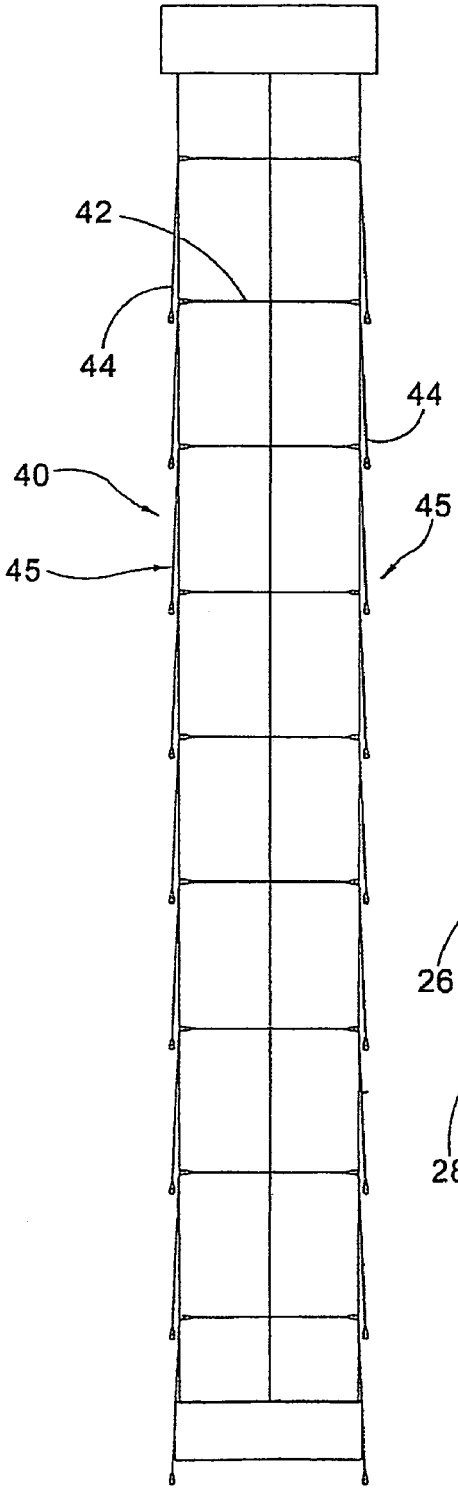
FIG. 7 is a side view of the blind shown in FIG. 6 with the blind in a fully lowered, open position.
Figure 6:
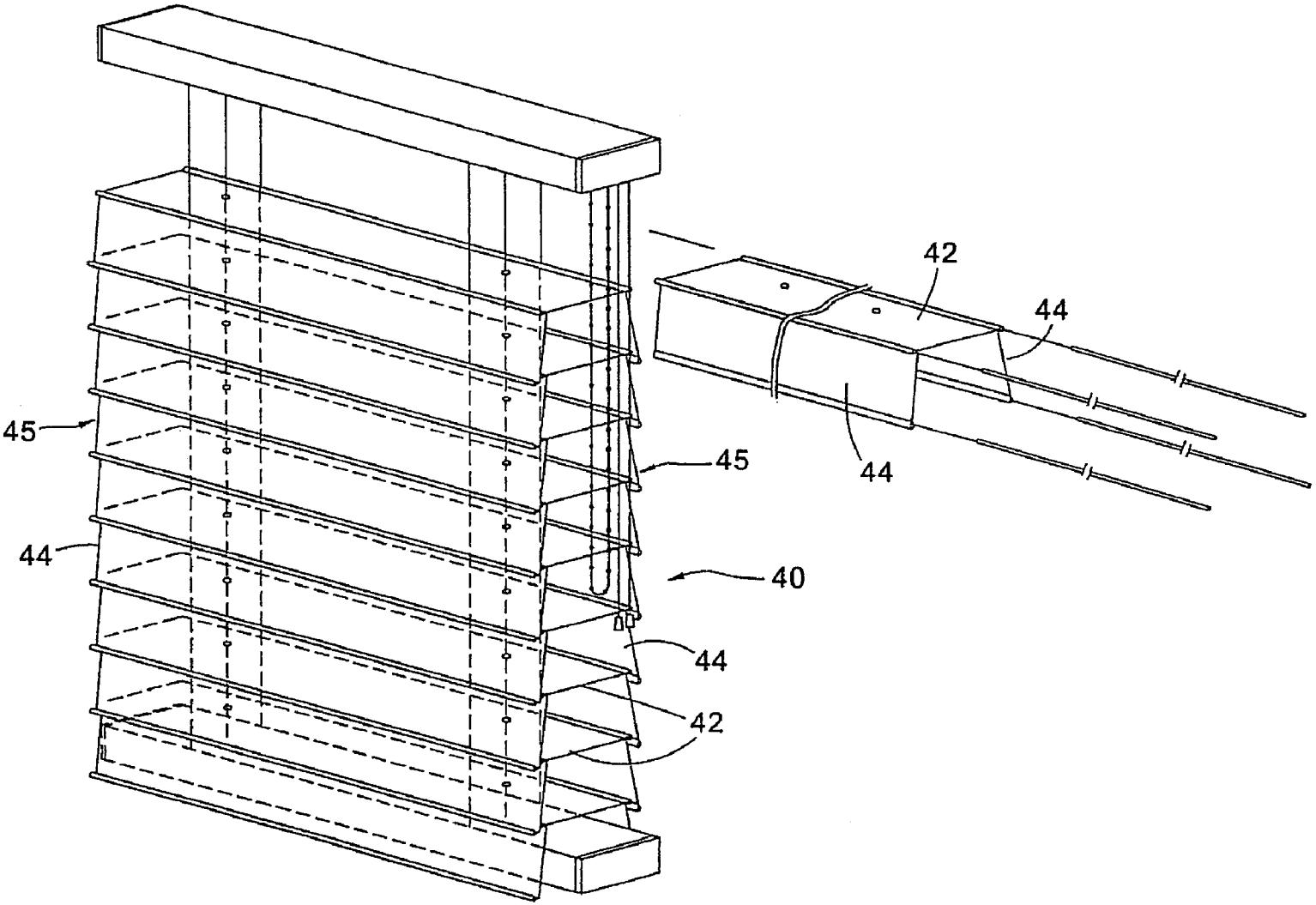
FIG. 6 is a perspective view, partially exploded, of a second preferred embodiment of the present invention.

FIGS. 6 and 7 show a second embodiment 40 that is similar to the window blind 10 shown in FIGS. 1 through 5 with the exception of the arrangement of flexible light screening flaps. According to this embodiment, flexible light screening flaps 44 of the slat units are respectively provided at the front and rear longitudinal edges of the flexible slats 42 of the slat units, forming a respective light screening face 45 at the front and rear sides of the flexible slats 42.

In the embodiments shown in FIGS. 1 through 7, the light screening flaps typically will be sewn into the fabric slats before the slats are connected to the rails. However, one could connect the light screening flaps to the fabric slats after the slats have been connected to the rails. In that event, the flaps may be attached to the slats with Velcro hook and loop fasteners or adhesive tape rather than being sewn into the fabric slats.

Although all of the window blinds shown in the drawings have fabric slats, the present method could be used with plastic, plastic film, metal, metal foil or wood slats that have pockets with slots along their longitudinal edges. Similarly, the light screening flaps could be a film rather than a fabric. The rails could be plastic, metal or wood rather than braided cord, particularly if plastic, metal or wood slats are used. Such a window covering would be more like a shutter than a venetian blind.

Figure 8:
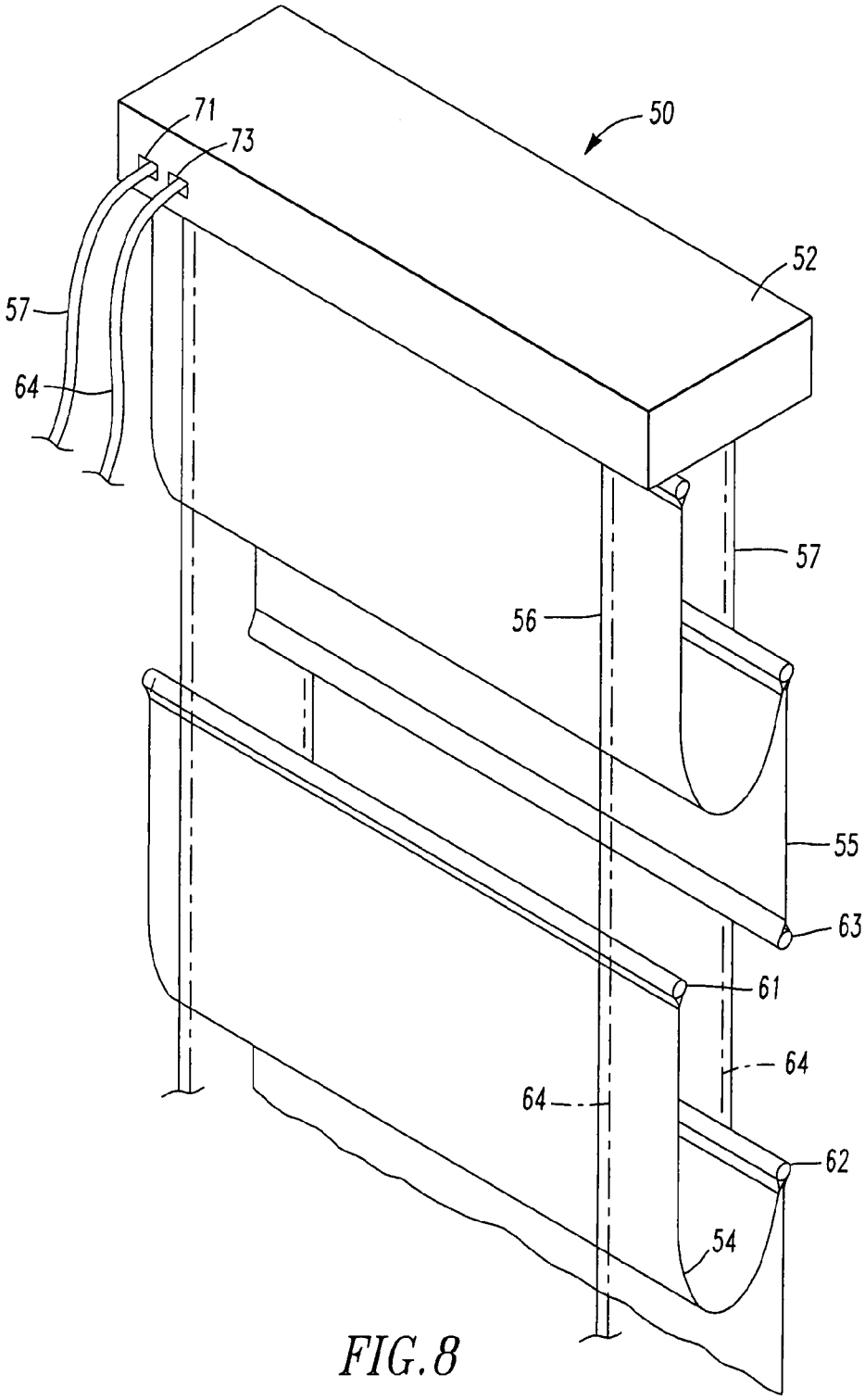
FIG. 8 is a perspective view of a third preferred embodiment of the present invention in a fully lowered, first open position.
Figure 9:
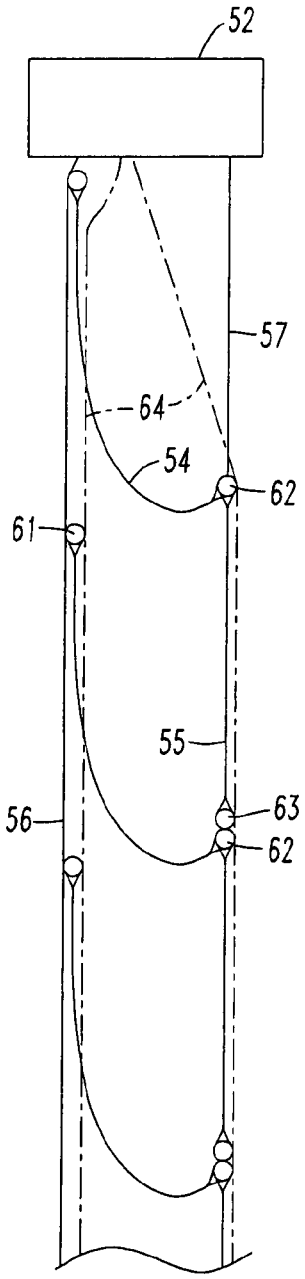
FIG. 9 is a side view of the upper portion of the blind shown in FIG. 9 with the blind in a fully lowered, closed position.
Figure 10:
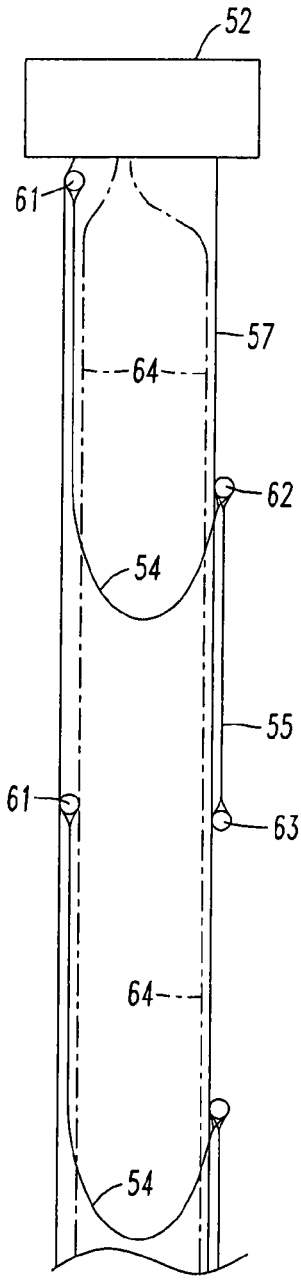
FIG. 10 is a side view similar to FIG. 9 of an upper portion of the showing the blind in a fully lowered, second open position.

In a third present preferred embodiment the shade elements to which the light screening flaps are attached are roman shade segments rather than venetian blind slats. Referring to FIGS. 8, 9 and 10 a third present preferred window covering 50 is comprised of a headrail 52 and a plurality of flexible shade elements 54 positioned sequentially below the haedrail, A first set of cords 56 extends from the headrail and is attached to a first longitudinal edge of the shade elements 54. A second set of cords 57 passes through cord lock 71 in the headrail and is attached to a second longitudinal edge of the shade elements 54. A flexible light screening flap 55 is attached to each shade element 54. The first longitudinal edge of the flap 55 is attached to the second longitudinal edge of the shade element 54 while the opposite longitudinal edge of each flap is free to move. Rods 61 and 62 are attached to both longitudinal edges of each shade element 54. A third rod 63 is provided on the free edge of each flap 55. The first cords 56 are attached at their upper ends to the headrail in a manner so that the ends of the cords are fixed relative to the headrail. We also provide a set of lift cords 64 that are substantially parallel to cords 56 and 57. The lift cords 64 pass through cord lock 73 and exit the headrail. By releasing the second cords 57 the second longitudinal edge of each shade element 54 can be lowered from the position shown in FIG. 10 to the position shown in FIG. 9 and then continue to be lowered to the position of the shade segments 54 shown in FIG. 8. In the position of FIG. 8 there are spaces between adjacent shade elements through which light may freely pass and the flaps 55 are obscured by the shade elements. This could be considered to be a fully lowered, fully open position. When the shade elements 54 are positioned as in FIG. 9, there are spaces between adjacent shade elements, but those spaces are covered by the flaps 55. Because the shade flaps are made of a mesh material light can pass through the flaps. The window covering in this position provides more privacy than the fully open position of FIG. 8 while allowing light to pass through the window covering. With the shade segments 54 elements positioned as in FIG. 10 one longitudinal edge of each shade element is adjacent a longitudinal edge of an adjacent shade element. Consequently, the shade elements fully cover a window over which the window covering is placed, providing complete privacy. If desired, a valance (not shown) could be provided on the headrail.

Although we have shown and described certain preferred embodiments of our window coverings it is to be distinctly understood that the invention is not limited thereto, but may be variously embodied within the scope of the following claims.

We claim:

1. A window covering comprising a headrail;

a plurality of lift cords extending from the headrail;

a plurality of shade elements positioned sequentially below the headrail, each shade element having a first longitudinal edge and a second longitudinal lower edge which edges are substantially parallel to one another;

a first cord attached to the first longitudinal edge of each shade element and extending from the headrail;

a second cord attached to the second longitudinal edge of each shade element extending from the headrail;

a plurality of flaps, each flap made of a mesh fabric, a non-woven fabric through which light may pass, or a film through which light may pass, each flap having a first longitudinal edge attached to the first longitudinal edge of each shade element and a second longitudinal edge, the second longitudinal edge being a free edge; and a control mechanism within the headrail and connected to at least one of the first cord and the second cord.

2. The window covering of claim 1 also comprising a bottom rail to which the lift cords are attached.

3. The window covering of claim 1 wherein the control mechanism is comprised of a cord lock attached to the headrail and through which at least one of the first cord and the second cord passes.

4. The window covering of claim 1 wherein the control mechanism is comprised of a shaft within the headrail on which at least one of the first cord and the second cord is wound.

5. The window covering of claim 1 also comprising a plurality of rods, one rod attached to the first longitudinal edge of each shade element.

6. The window covering of claim 1 also comprising a plurality of rods, one rod attached to the first longitudinal edge of each shade element.

7. The window covering of claim 1 also comprising a plurality of rods, one rod attached to the free edge of each flap.

8. The window covering of claim 1 wherein the plurality of shade elements are each comprised of a material selected from the group consisting of woven fabrics, non-woven fabrics, films, woven woods and woven grasses.

9. The window covering of claim 1 wherein at least one of the first cord and the second cord are a tape or a strip of fabric.

10. The window covering of claim 1 also comprising a bottom shade element to which one of the first cord and the second cord are attached.

11. The window covering of claim 1 wherein the plurality of shade elements are slats.

12. The window covering of claim 1 wherein the plurality of shade elements are portions of a roman shade.

* * * * *